US007646142B2

(12) United States Patent
Kang et al.

(10) Patent No.: US 7,646,142 B2
(45) Date of Patent: Jan. 12, 2010

(54) FIELD EMISSION DEVICE (FED) HAVING CATHODE APERTURE TO IMPROVE ELECTRON BEAM FOCUS AND ITS METHOD OF MANUFACTURE

(75) Inventors: Ho-Suk Kang, Seoul (KR); Jun-Hee Choi, Suwon-si (KR); Byong-Gwon Song, Seoul (KR); Ha-Jong Kim, Seongnam-si (KR)

(73) Assignee: Samsung SDI Co., Ltd., Yeongtong-gu, Suwon-si, Gyeonggi-do (KR)

( * ) Notice: Subject to any disclaimer, the term of this patent is extended or adjusted under 35 U.S.C. 154(b) by 487 days.

(21) Appl. No.: 11/223,031

(22) Filed: Sep. 12, 2005

(65) Prior Publication Data

US 2006/0055304 A1 Mar. 16, 2006

(30) Foreign Application Priority Data

Sep. 14, 2004 (KR) ..... 10-2004-0073365

(51) Int. Cl.

| | |
|---|---|
| ***H01J 19/06*** | (2006.01) |
| ***H01J 1/14*** | (2006.01) |
| ***H01K 1/04*** | (2006.01) |
| *H01J 1/62* | (2006.01) |

(52) U.S. Cl. ..... 313/495; 313/309; 313/310; 445/50; 445/51

(58) Field of Classification Search ..... 313/498, 313/495–497, 293–304, 309–310
See application file for complete search history.

(56) References Cited

U.S. PATENT DOCUMENTS 5,247,223 A * 9/1993 Mori et al. ..... 313/308
5,319,279 A * 6/1994 Watanabe et al. ..... 313/309
5,534,743 A * 7/1996 Jones et al. ..... 313/309
6,034,468 A * 3/2000 Wilshaw ..... 313/309
6,297,592 B1 * 10/2001 Goren et al. ..... 315/3.5
6,552,478 B2 * 4/2003 Derraa ..... 313/309
6,686,680 B2 * 2/2004 Shaw et al. ..... 313/309

(Continued)

FOREIGN PATENT DOCUMENTS

KR 1020030055883 * 10/2005

OTHER PUBLICATIONS

Kim et al., "New Resistive Layer for Field Emission Display: Realization of Putting Lateral Resistor to individual Microtip", Japanese Society of Applied Physics, Japanese Journal of Applied Physics, vol. 41 (2002) pp. 301-305, Part 1, No. 1 Jan. 2002.*

*Primary Examiner*—Sikha Roy
*Assistant Examiner*—Tracie Green
(74) *Attorney, Agent, or Firm*—Robert E. Bushnell, Esq.

(57) ABSTRACT

A Field Emission Device (FED) and its method of manufacture includes: forming a substrate; forming a cathode having a cathode aperture on an upper surface of the substrate; forming a material layer having a first through hole with a smaller diameter than that of the cathode aperture on an upper surface of the cathode; forming a first insulator having a first cavity on an upper surface of the material layer; forming a gate electrode having a second through hole on an upper surface of the first insulator; and forming an emitter in a central portion of the cathode aperture.

23 Claims, 10 Drawing Sheets

U.S. PATENT DOCUMENTS

| | | | | |
|---|---|---|---|---|
| 7,005,783 | B2 * | 2/2006 | Hwu et al. | 313/293 |
| 7,180,234 | B2 | 2/2007 | Oono | |
| 7,264,978 | B2 | 9/2007 | Ito | |
| 7,268,480 | B2 | 9/2007 | Choi et al. | |
| 7,276,843 | B2 | 10/2007 | Sasaguri | |
| 7,348,722 | B2 | 3/2008 | Ahn et al. | |
| 7,372,197 | B2 | 5/2008 | Ahn et al. | |
| 7,495,377 | B2 | 2/2009 | Han et al. | |
| 7,504,767 | B2 | 3/2009 | Moradi et al. | |
| 7,504,768 | B2 | 3/2009 | Oh | |
| 7,511,412 | B2 | 3/2009 | Kim | |
| 2002/0014832 | A1 * | 2/2002 | Moradi et al. | 313/497 |
| 2002/0036452 | A1 * | 3/2002 | Muroyama et al. | 313/310 |
| 2002/0175617 | A1 * | 11/2002 | Lee et al. | 313/495 |
| 2003/0001477 | A1 * | 1/2003 | Sasaguri | 313/310 |
| 2004/0004429 | A1 | 1/2004 | Oh et al. | |
| 2004/0080260 | A1 * | 4/2004 | Park et al. | 313/495 |
| 2004/0183420 | A1 | 9/2004 | Jin et al. | |
| 2005/0035701 | A1 * | 2/2005 | Choi et al. | 313/309 |
| 2005/0077811 | A1 * | 4/2005 | Sun et al. | 313/495 |
| 2005/0116612 | A1 * | 6/2005 | Oh | 313/497 |
| 2005/0168128 | A1 * | 8/2005 | Kang | 313/495 |
| 2005/0236962 | A1 | 10/2005 | Lee | |
| 2006/0012277 | A1 * | 1/2006 | Park et al. | 313/309 |

* cited by examiner

FIELD EMISSION DEVICE (FED) HAVING CATHODE APERTURE TO IMPROVE ELECTRON BEAM FOCUS AND ITS METHOD OF MANUFACTURE

CLAIM OF PRIORITY

This application makes reference to, incorporates the same herein, and claims all benefits accruing under 35 U.S.C.§119 from an application for FIELD EMISSION DEVICE AND METHOD OF MANUFACTURING THE SAME earlier filed in the Korean Intellectual Property Office on 14 Sep. 2004 and there duly assigned Serial No. 10-2004-0073365.

BACKGROUND OF THE INVENTION

1. Field of the Invention

The present invention relates to a Field Emission Device (FED) and its method of manufacture, and more particularly, to an FED having a good ability to focus electron beams, thereby attaining a high brightness, and its method of manufacture.

2. Description of the Related Art

Display devices for conventional information communication media include monitors for Personal Computers (PCs), TV receivers, and the like. These display devices are divided into Cathode Ray Tubes (CRTs) and flat panel displays. The CRTs use high-speed thermal electron emission. Improvements in flat panel displays have recently been occurring at a high rate. The flat panel displays include Liquid Crystal Displays (LCDs), Plasma Display Panels (PDPs), Field Emission Devices (FEDs), and the like.

FEDs operate using the following method. First, a strong electric field is formed between a gate electrode and emitters, which are disposed at predetermined intervals on a cathode. As a result, electrons are emitted from the emitters. The electrons collide with a fluorescent layer formed on an anode, thus emitting light. An FED has a thickness of a few centimeters. In addition, FEDs have many advantages, including wide viewing angles, low power consumption, low manufacturing costs, and the like. Therefore, FEDs have drawn much attention as a next-generation display, along with LCDs and PDPs.

An FED includes a cathode, a first insulator, and a gate electrode sequentially deposited on a substrate. An emitter aperture is formed in the first insulator to expose an upper surface of the cathode. An emitter is placed inside the emitter aperture. A second insulator is formed on the gate electrode, and a focus electrode is formed on an upper surface of the second insulator to focus electron beams emitted from the emitter.

However, when a high voltage is supplied to an anode of this FED to obtain a high brightness, electron beams disperse, thus reducing color purity.

SUMMARY OF THE INVENTION

The present invention provides a Field Emission Device (FED) having a good ability to focus electron beams, thereby attaining a high brightness, and its method of manufacture.

According to one aspect of the present invention, a Field Emission Device (FED) is provided comprising: a substrate; a cathode having a cathode aperture and arranged on an upper surface of the substrate; a material layer having a first through hole of a smaller diameter than that of the cathode aperture and arranged on an upper surface of the cathode, the first through hole being arranged above a central portion of the cathode aperture; a first insulator having a first cavity connected to the first through hole and arranged on an upper surface of the material layer; a gate electrode having a second through hole connected to the first cavity and arranged on an upper surface of the first insulator; and an emitter arranged in the central portion of the cathode aperture.

A height of the emitter is preferably equal to or less than a height of the cathode aperture.

The emitter preferably comprises carbon nano-tubes (CNTs), graphite nano-particles, or nano-diamonds.

The height of the cathode aperture is preferably less than 5 μm. The cathode preferably comprises a first electrode arranged on the upper surface of the substrate, and a second electrode having the cathode aperture arranged on the first electrode.

A thickness of the first electrode is preferably less than 0.1 μm.

The first electrode preferably comprises Indium Tin Oxide (ITO).

A thickness of the second electrode is preferably less than 5 μM. The second electrode preferably comprises at least one material selected from the group consisting of Cr, Ag, Al, and Au.

The material layer preferably comprises amorphous silicon (a-Si).

The FED preferably further comprises a second insulator having a second cavity connected to the second through hole and arranged on an upper surface of the gate electrode.

The FED preferably further comprises a focus electrode having a third through hole connected to the second cavity and arranged on an upper surface of the second insulator.

According to another aspect of the present invention, a method of manufacturing a Field Emission Device (FED) is provided, the method comprising: forming a cathode on an upper surface of a substrate; forming a predetermined material layer on an upper surface of the cathode and patterning the predetermined material layer to form a first through hole; etching a portion of the cathode exposed by the first through hole to form a cathode aperture, wherein the cathode aperture has a larger diameter than that of the first through hole; forming a first insulator on an upper surface of the material layer; forming a gate electrode on an upper surface of the first insulator and then patterning the gate electrode to form a second through hole; forming a second insulator on an upper surface of the gate electrode; forming a focus electrode on an upper surface of the second insulator and patterning the focus electrode to form a third through hole; etching the second insulator exposed by the third through hole to form a second cavity; etching the first insulator exposed by the second through hole to form a first cavity; and forming an emitter in a central portion of the cathode aperture.

Forming the cathode preferably further comprises forming a first electrode on the upper surface of the substrate, and preferably forming a second electrode on an upper surface of the first electrode.

The first electrode is preferably formed to a thickness of less than 0.1 μm. The first electrode is preferably formed of Indium Tin Oxide (ITO).

The second electrode is preferably formed to a thickness of less than 5 μm. The second electrode is preferably formed of at least one material selected from the group consisting of Cr, Ag, Al, and Au.

The material layer is preferably formed of amorphous silicon (a-Si).

Forming the cathode hole preferably comprises isotropically etching a portion of the second electrode exposed by the first through hole.

The height of the emitter is preferably formed to be equal to or less than the height of the cathode aperture.

Forming the emitter preferably comprises filling the cathode aperture with an electron emission material and patterning the filled electron emission material. The electron emission material is preferably formed of carbon nano-tubes (CNTs), graphite nano-particles, or nano-diamonds.

BRIEF DESCRIPTION OF THE DRAWINGS

A more complete appreciation of the present invention and many of the attendant advantages thereof, will be readily apparent as the present invention becomes better understood by reference to the following detailed description when considered in conjunction with the accompanying drawings in which like reference symbols indicate the same or similar components, wherein.

DETAILED DESCRIPTION OF THE INVENTION

Figure 1:
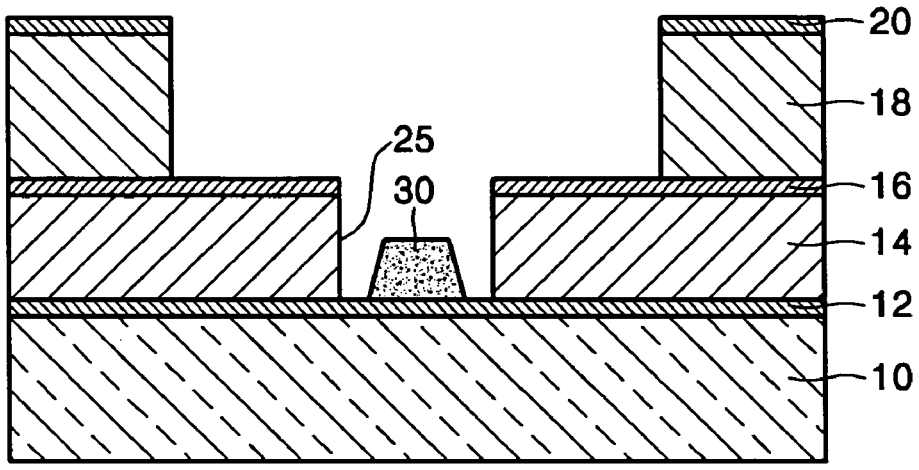
FIG. 1 is a sectional view of a Field Emission Device (FED)

FIG. 1 is a sectional view of an FED. Referring to FIG. 1, a cathode 12, a first insulator 14, and a gate electrode 16 are sequentially deposited on a substrate 10. An emitter aperture 25 is formed in the first insulator 14 to expose an upper surface of the cathode 12. An emitter 30 is placed inside the emitter aperture 25. A second insulator 18 is formed on the gate electrode 16, and a focus electrode 20 is formed on an upper surface of the second insulator 18 to focus electron beams emitted from the emitter 30.

However, when a high voltage is supplied to an anode (not shown) of such an FED to obtain a high brightness, electron beams disperse, thus reducing color purity.

The present invention will now be described more fully with reference to the accompanying drawings, in which exemplary embodiments of the present invention are shown. Like reference numerals in the drawings denote like elements.

Figure 2:
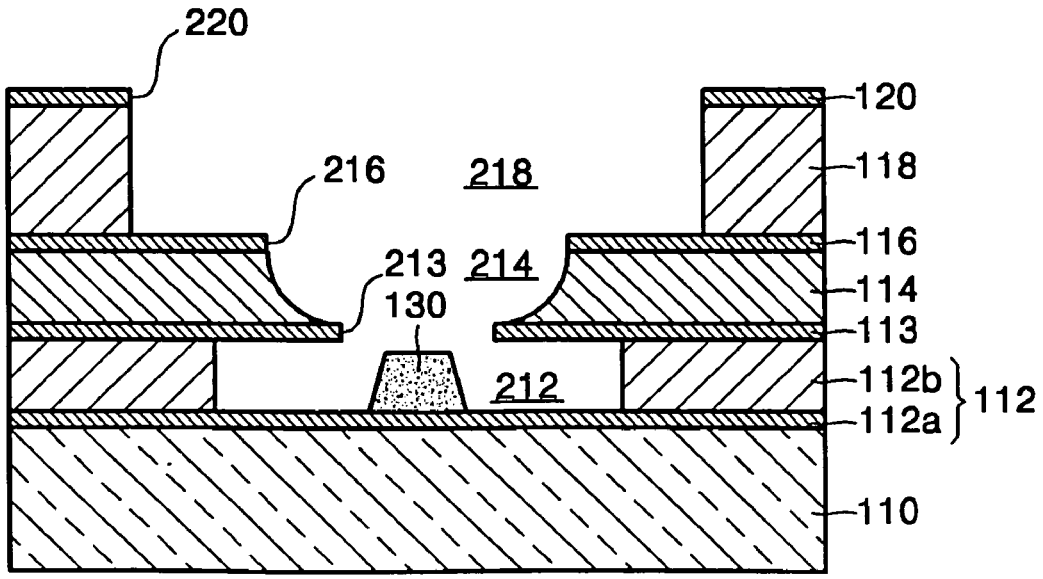
FIG. 2 is a sectional view of an FED according to an embodiment of the present invention.

FIG. 2 is a sectional view of a FED according to an embodiment of the present invention.

Referring to FIG. 2, the FED includes a substrate 110, a cathode 112 in which a cathode aperture 212 is formed, a gate electrode 116 formed on the cathode 112, and an emitter 130 formed in a central portion of the cathode aperture 212.

The substrate 110 can be composed of glass. The cathode electrode 112 includes a first electrode 112*a* formed on an upper surface of the substrate and a second electrode 112*b* formed on an upper surface of the first electrode 112*a*. The cathode 112 is much thicker than a cathode of conventional FEDs. The cathode aperture 212 is formed in the second electrode 112*b*.

The first electrode 112*a* has the thickness of less than about 0.1 μm and is composed of a transparent conducting material such as Indium Tin Oxide (ITO). The upper surface of the first electrode 112*a* forms a bottom surface of the cathode aperture 212. The second electrode 112*b* is composed of at least one material selected from the group consisting of Cr, Ag, Al, and Au. The second electrode 112*b* has a thickness of less than 5 μm, and preferably, 0.1 to 5 μm. Since the cathode aperture 212 penetrates the second electrode 112*b*, the cathode aperture 212 has the same height as the second electrode 112*b*.

A predetermined material layer 113 is formed on an upper surface of the second electrode 112*b* to cover a portion of an upper surface of the cathode aperture 212. A first through hole 213 is formed in the material layer 113 above the central portion of the cathode aperture 212. The first through hole 213 has a smaller diameter than that of the cathode aperture 212. The material layer 113 is composed of amorphous silicon (a-Si), for example.

The emitter 130 is formed in the central portion of the cathode aperture 212. The emitter 130 has a much smaller diameter than that of the cathode aperture 212. The height of the emitter 130 is equal to or less than the height of the cathode aperture 212. Therefore, the electron beam produced by the emitter 130 can be more focused than in conventional FEDs.

The emitter 130 is composed of carbon nano-tubes (CNTs), graphite nano-particles, nano-diamonds, or the like.

A first insulator 114 is formed to a predetermined thickness on an upper surface of the material layer 113. A first cavity 214 connected to the first through hole 213 is formed in the first insulator 114. The first insulator 114 is composed of an insulating material, such as $SiO_2$.

A gate electrode 116 is formed on an upper surface of the first insulator 114 to extract electrons from the emitter 130. The gate electrode 116 is disposed perpendicular to the cathode 112. A second through hole 216 connected to the first cavity 214 is formed in the gate electrode 116. The gate electrode 116 is composed of a conducting metal or a transparent conducting material, for example. The transparent conducting material can be, for example, ITO.

A second insulator 118 is formed to a predetermined thickness on an upper surface of the gate electrode 116. A second cavity 218 connected to the second through hole 216 is formed in the second insulator 118. The second insulator 118 is composed of an insulating material, such as $SiO_2$.

A focus electrode 120 is formed on an upper surface of the second insulator 118. A third through hole 220 connected to the second cavity 218 is formed in the focus electrode 120. The focus electrode 120 controls the loci of electron beams emitted from the emitter 130. The focus electrode 120 is composed of a conducting metal or a transparent conducting material, for example. The transparent conducting material can be, for example, ITO.

In the FED according to the present embodiment, the emitter 130 has a much smaller diameter than that of the cathode aperture 212, and the height of the emitter 130 formed in the central portion of the cathode aperture 212 is equal to or less than the height of the cathode aperture 212. As a result, the electron beams emitted from the emitter 130 are more focused than in conventional FEDs.

Figure 3A:
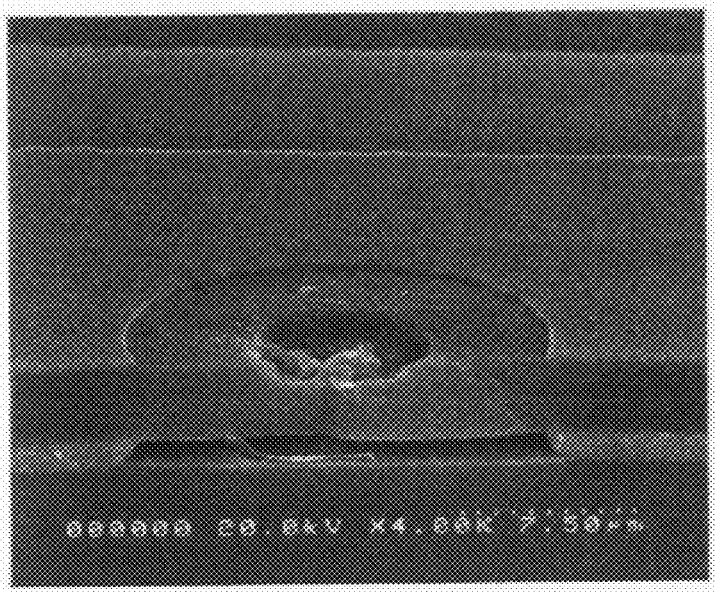
FIGS. 3A through 3D are Scanning Electron Microscopy (SEM) images of an FED according to an embodiment of the present invention.
Figure 3B:
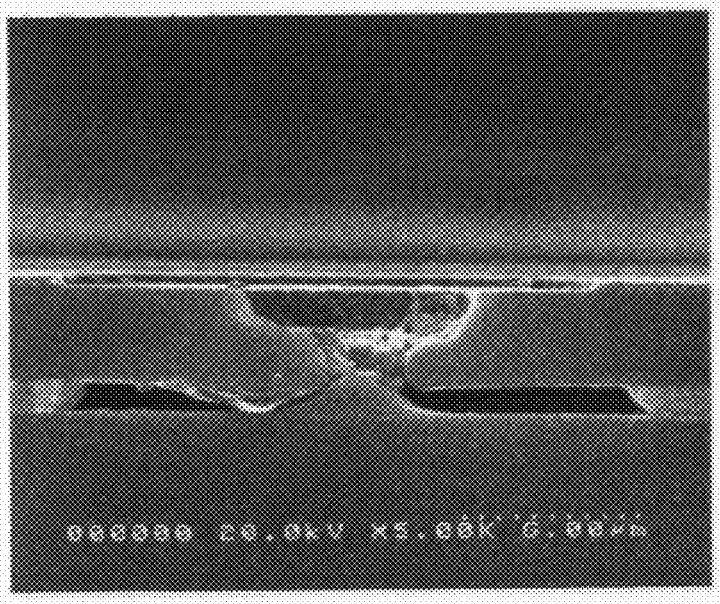
Figure 3C:
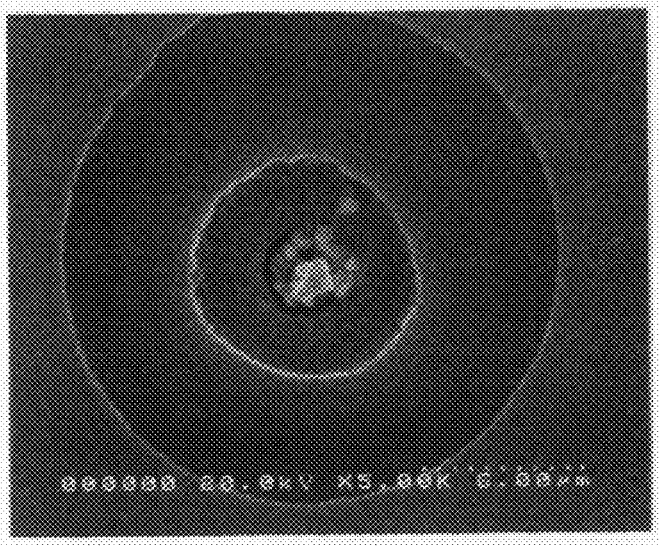
Figure 3D:
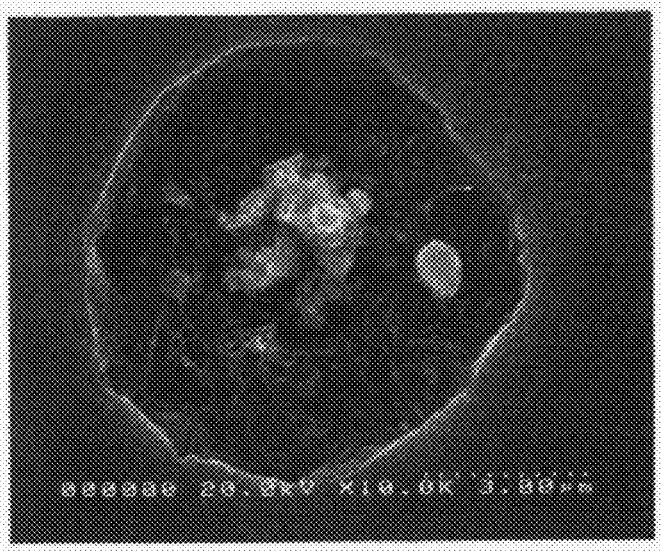
Figure 4A:
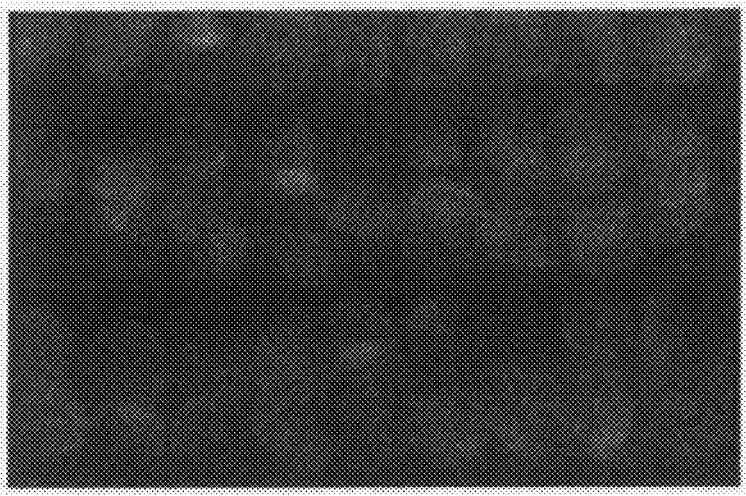
FIGS. 4A through 4D are images formed by an FED according to an embodiment of the present invention when 70V, 80V, 90V, and 100V are respectively supplied to a gate electrode.
Figure 4B:
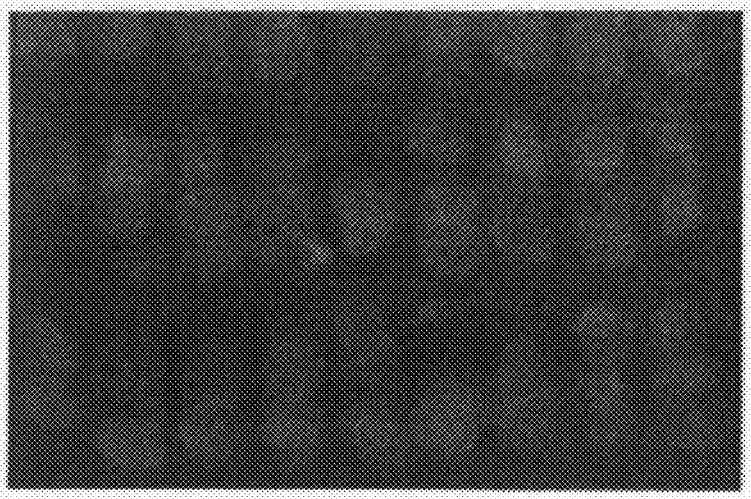
Figure 4C:
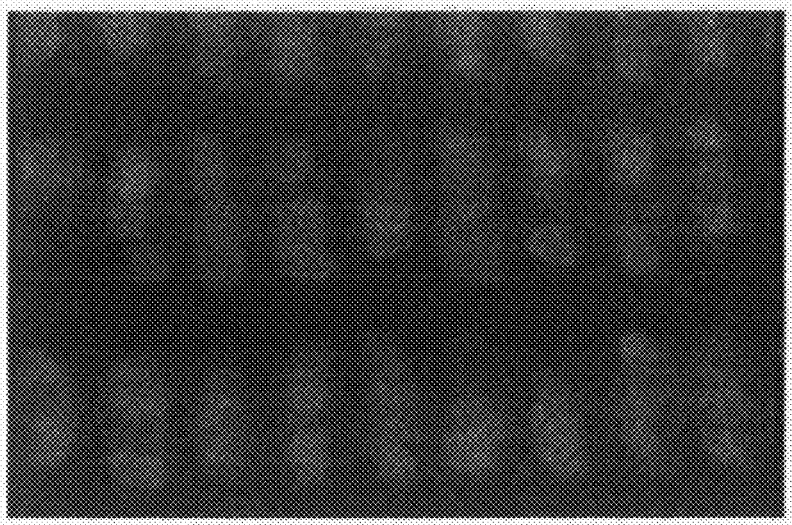
Figure 4D:
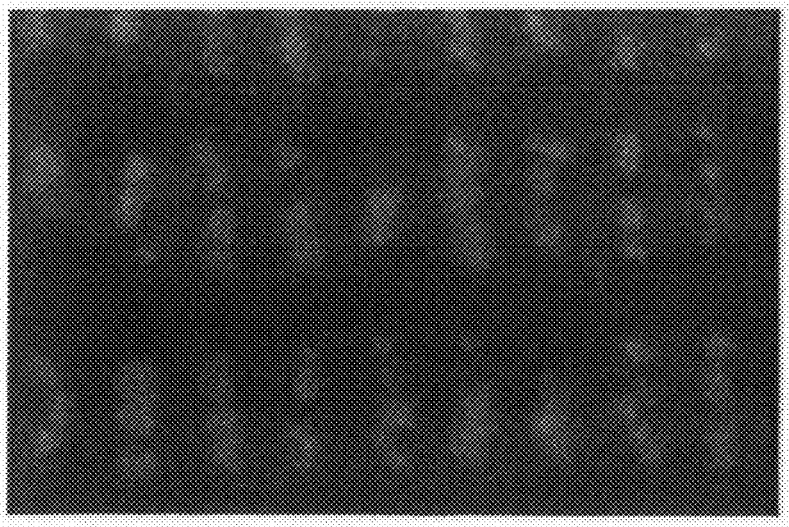

FIGS. 3A through 3D are Scanning Electron Microscopy (SEM) images of an FED according to an embodiment of the present invention. In more detail, FIGS. 3A and 3B are SEM images of cross-sections of the FED. FIG. 3C is a plan view of the FED, and FIG. 3D is a magnified view of the image of FIG. 3C. Referring to FIGS. 3A through 3D, a thick cathode electrode having a cathode aperture is formed on a substrate. An emitter is formed in the central portion of the cathode aperture, and has a much smaller diameter than that of the cathode aperture.

FIGS. 4A through 4D are images formed by the FED according to an embodiment of the present invention when 70V, 80V, 90V, and 100V are respectively supplied to a gate electrode. A voltage of 1.5 kV is supplied to an anode, and a voltage of 0V is supplied to a focus electrode. Referring to FIGS. 4A through 4D, a higher voltage supplied to the gate electrode results in a higher resolution.

A method of manufacturing an FED according to an embodiment of the present invention will now be described with reference to FIGS. 5A through 5I.

Figure 5A:
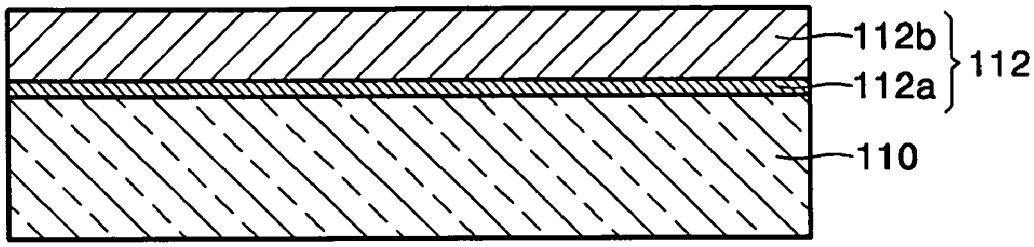
FIGS. 5A through 5I are views of a method of manufacture of an FED according to an embodiment of the present invention.

First, referring to FIG. 5A, a cathode 112 is formed on a substrate 110. The cathode 112 is composed of first and second electrodes 112*a* and 112*b*. The substrate 110 is composed of glass, for example. The first electrode 112*a* is formed by depositing a transparent conducting material, such as ITO, to the thickness of less than about 0.1 μm on an upper surface of the substrate 110. The second electrode 112*b* is formed by depositing at least one material selected from the group consisting of Cr, Ag, Al, and Au on an upper surface of a first electrode 112*a*. The second electrode 112*b* has a thickness of less than 5 μm, and preferably, 0.1 to 5 μm.

Figure 5B:
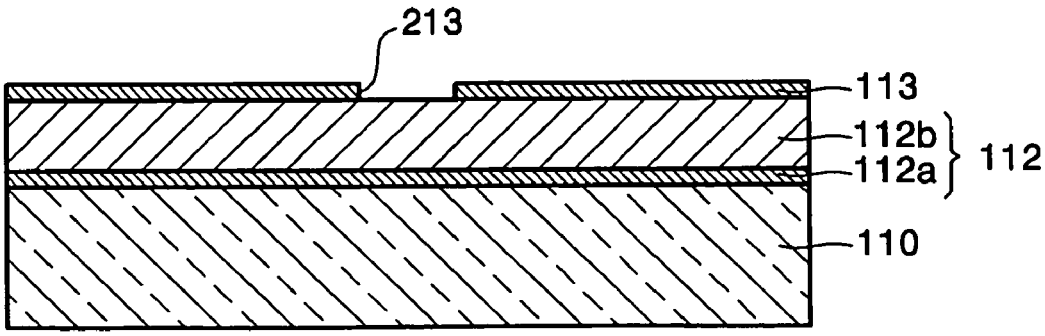

Referring to FIG. 5B, a predetermined material layer 113 is formed on an upper surface of the second electrode 112*b*, and patterned to form a first through hole 213. The material layer 113 is composed of amorphous silicon (a-Si), for example.

Figure 5C:
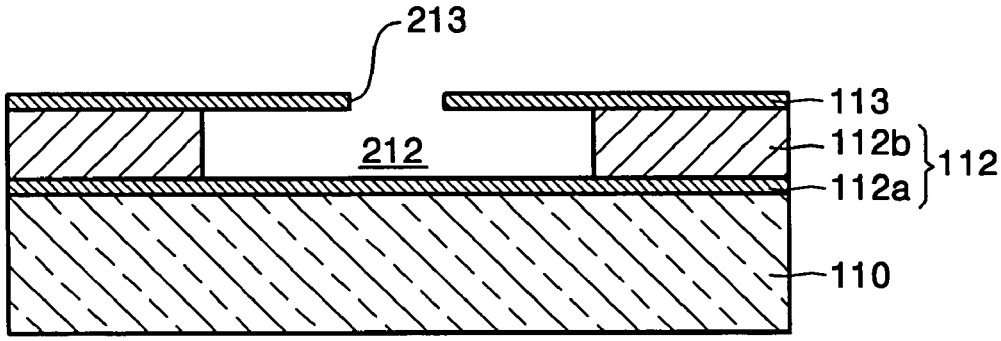

Referring to FIG. 5C, a cathode aperture 212 is formed by isotropically etching a portion of the second electrode 112*b* exposed by the first through hole 213. As a result, the cathode aperture 212 formed in the second electrode 112*b* has a larger diameter than that of the first through hole 213.

Figure 5D:
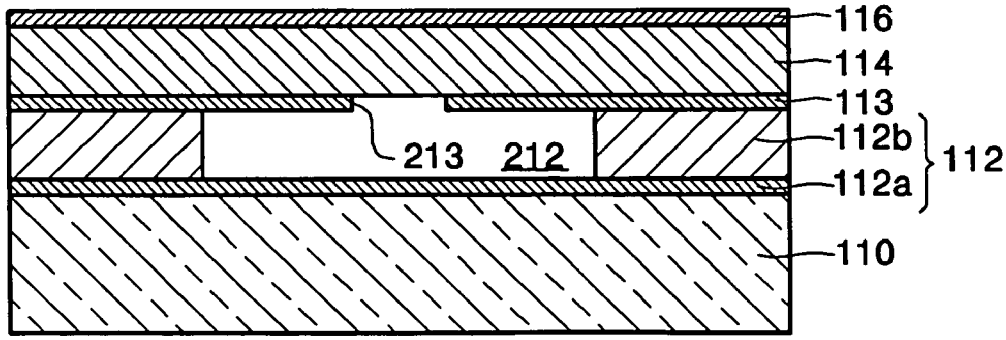

Referring to FIG. 5D, a first insulator 114 is formed on an upper surface of the material layer 113, and then a gate electrode 116 is formed on the first insulator 114. The first insulator 114 is formed by depositing an insulating material, such as $SiO_2$, to a predetermined thickness on the upper surface of the material layer 113. The gate electrode 116 is formed by depositing a metal or a transparent conducting material, for example, on an upper surface of the first insulator 114. The transparent conducting material is, for example, ITO.

Figure 5E:
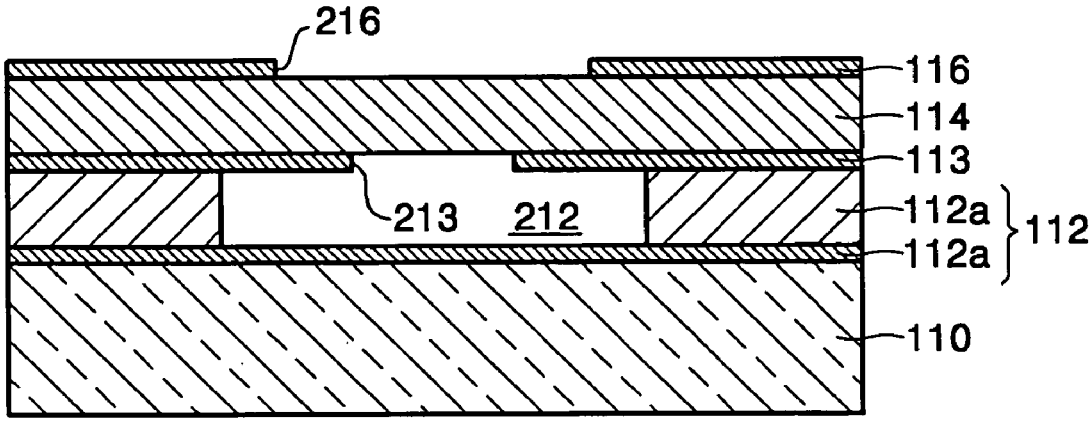

Referring to FIG. 5E, the gate electrode 116 is patterned to form a second through hole 216.

Figure 5F:
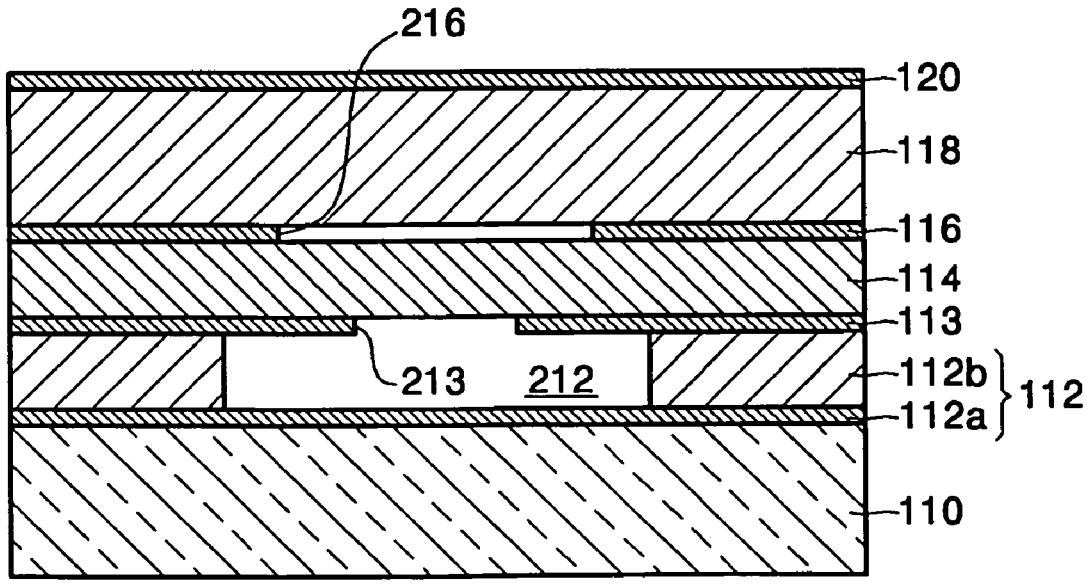

Referring to FIG. 5F, a second insulator 118 is formed on an upper surface of the gate electrode 116, and then a focus electrode 120 is formed on the second insulator 118. The second insulator layer 118 is formed by depositing an insulating material, such as $SiO_2$, to a predetermined thickness on the upper surface of the gate electrode 116. The focus electrode 120 is formed by depositing a metal or a transparent conducting material on an upper surface of the second insulator 118. The transparent conducting material is, for example, ITO.

Figure 5G:
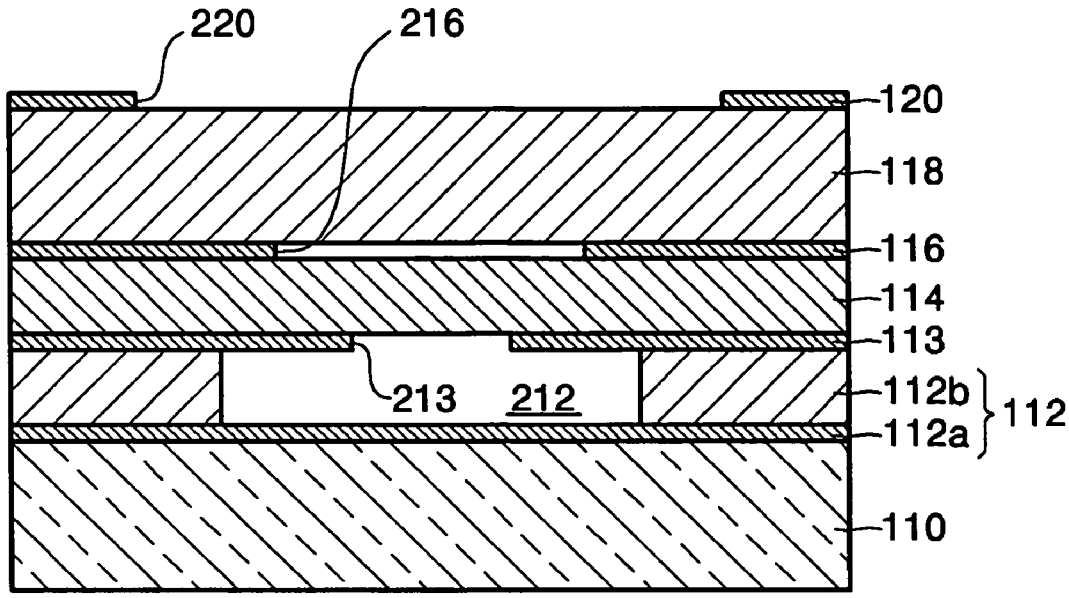

Referring to FIG. 5G, the focus electrode 120 is patterned to form a third through hole 220.

Figure 5H:
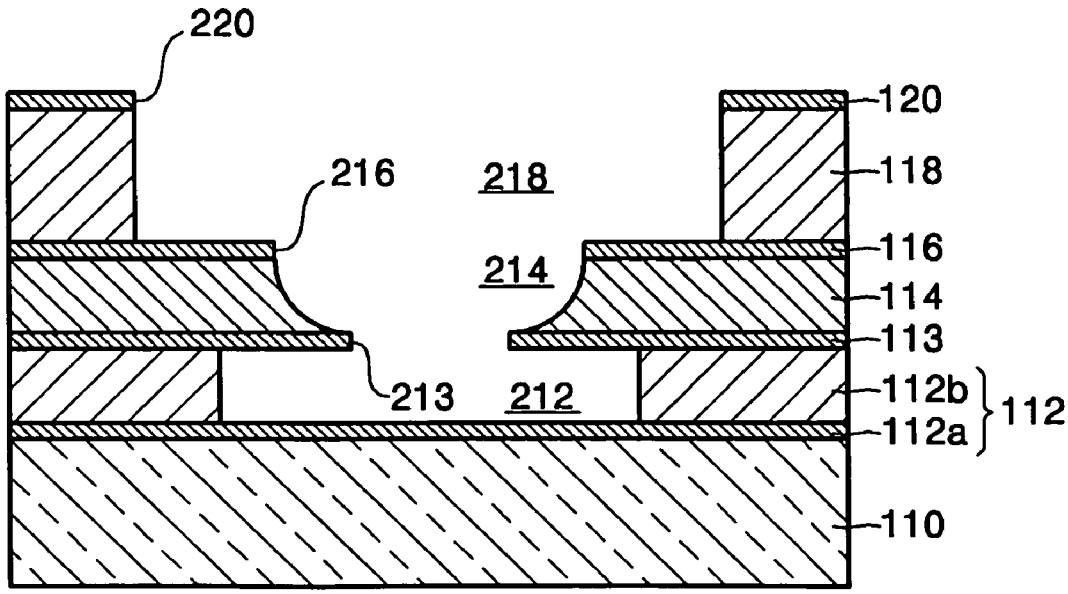

Referring to FIG. 5H, a second cavity 218 connected to the third through hole 220 is formed in the second insulator 118, and a first cavity 214 connected to the second through hole 216 is formed in the first insulator 114. The second cavity 218 is formed by etching the second insulator 118 exposed by the third through hole 220. The first cavity 214 is formed by etching a portion of the first insulator 114 exposed by the second through hole 216.

Figure 5I:
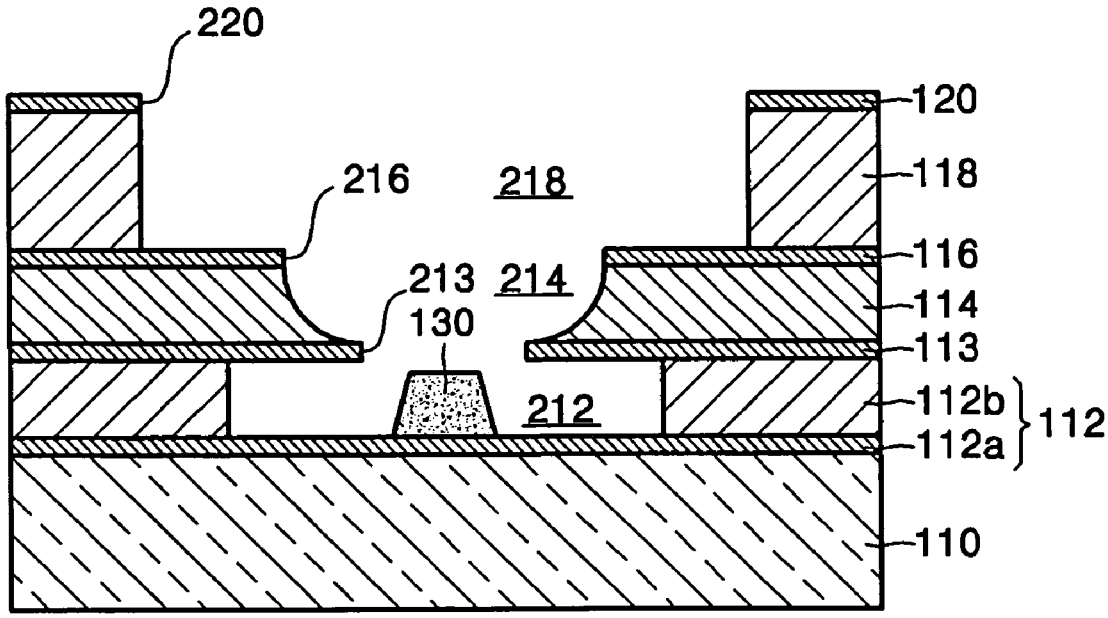

Referring to FIG. 5I, an emitter is formed in a central portion of the cathode aperture 212. The height of the emitter 130 is equal to or less than the height of the cathode aperture 212. The emitter 212 is formed by filling the cathode aperture 212 with a predetermined electron emission material and then patterning the electron emission material. The electron emission material is, for example, CNT, graphite nano-particles, nano-diamonds, or the like.

A FED according an embodiment of the present invention includes a cathode having a greater thickness than an electrode of a conventional FED. In addition, the cathode has a cathode aperture having a greater diameter than that of the emitter. As a result, in the FED according to the present invention, electron beams are highly focused to obtain a high brightness, thereby realizing high-resolution images.

While the present invention has been particularly shown and described with reference to exemplary embodiments thereof, it will be understood by those of ordinary skill in the art that various modifications in form and detail can be made therein without departing from the spirit and scope of the present invention as defined by the following claims.

What is claimed is:

1. A Field Emission Device (FED), comprising:

a substrate;

a cathode having a cathode aperture and arranged on an upper surface of the substrate;

a material layer having a first through hole of a smaller diameter than that of the cathode aperture and arranged on an upper surface of the cathode, the first through hole being arranged above a central portion of the cathode aperture;

a first insulator having a first cavity connected to the first through hole and arranged on an upper surface of the material layer;

a gate electrode having a second through hole connected to the first cavity and arranged on an upper surface of the first insulator; and an emitter arranged in the central portion of the cathode aperture;

wherein the cathode comprises a first electrode arranged on the upper surface of the substrate, and a second electrode having the cathode aperture arranged on the first electrode.

2. The FED of claim 1, wherein a height of the emitter is equal to or less than a height of the cathode aperture.

3. The FED of claim 1, wherein the emitter comprises carbon nano-tubes (CNTs), graphite nano-particles, or nano-diamonds.

4. The FED of claim 1, wherein the height of the cathode aperture is less than 5 μm.

5. The FED of claim 1, wherein a thickness of the first electrode is less than 0.1 μm.

6. The FED of claim 1, wherein the first electrode comprises Indium Tin Oxide (ITO).

7. The FED of claim 1, wherein a thickness of the second electrode is less than 5 μm.

8. The FED of claim 1, wherein the second electrode comprises at least one material selected from the group consisting of Cr, Ag, Al, and Au.

9. The FED of claim 1, wherein the material layer comprises amorphous silicon (a-Si).

10. The FED of claim 1, further comprising a second insulator having a second cavity connected to the second through hole and arranged on an upper surface of the gate electrode.

11. The FED of claim 10, further comprising a focus electrode having a third through hole connected to the second cavity and arranged on an upper surface of the second insulator.

12. A method of manufacturing a Field Emission Device (FED), the method comprising:

forming a cathode on an upper surface of a substrate;

forming a predetermined material layer on an upper surface of the cathode and patterning the predetermined material layer to form a first through hole;

etching a portion of the cathode exposed by the first through hole to form a cathode aperture, wherein the cathode aperture has a larger diameter than that of the first through hole;

forming a first insulator on an upper surface of the material layer;

forming a gate electrode on an upper surface of the first insulator and then patterning the gate electrode to form a second through hole;

forming a second insulator on an upper surface of the gate electrode;

forming a focus electrode on an upper surface of the second insulator and patterning the focus electrode to form a third through hole;

etching the second insulator exposed by the third through hole to form a second cavity;

etching the first insulator exposed by the second through hole to form a first cavity; and forming an emitter in a central portion of the cathode aperture.

13. The method of claim 12, wherein forming the cathode further comprises forming a first electrode on the upper surface of the substrate, and forming a second electrode on an upper surface of the first electrode.

14. The method of claim 13, wherein the first electrode is formed to a thickness of less than 0.1 μm.

15. The method of claim 13, wherein the first electrode is formed of Indium Tin Oxide (ITO).

16. The method of claim 13, wherein the second electrode is formed to a thickness of less than 5 μm.

17. The method of claim 13, wherein the second electrode is formed of at least one material selected from the group consisting of Cr, Ag, Al, and Au.

18. The method of claim 12, wherein the material layer is formed of amorphous silicon (a-Si).

19. The method of claim 13, wherein forming the cathode aperture comprises isotropically etching a portion of the second electrode exposed by the first through hole.

20. The method of claim 12, wherein the height of the emitter is formed to be equal to or less than the height of the cathode aperture.

21. The method of claim 20, wherein forming the emitter comprises filling the cathode aperture with an electron emission material and patterning the filled electron emission material.

22. The method of claim 21, wherein the electron emission material is formed of carbon nano-tubes (CNTs), graphite nano-particles, or nano-diamonds.

23. A field emission device manufactured by the method of claim 14, wherein:

a height of the emitter is equal to or less than a height of the cathode aperture;

the emitter comprises carbon nano-tubes (CNTs), graphite nano-particles, or nano-diamonds; and the height of the cathode aperture is less than 5 μm.

* * * * *